United States Patent [19]

Ganic

[11] 4,398,392

[45] Aug. 16, 1983

[54] SYSTEM FOR SEPARATION OF WATER FROM THE WORKING FLUID IN LOW TEMPERATURE DIFFERENCE POWER PLANTS

[75] Inventor: Ejup N. Ganic, Oak Park, Ill.

[73] Assignee: University of Illinois Foundation, Urbana, Ill.

[21] Appl. No.: 300,988

[22] Filed: Sep. 10, 1981

[51] Int. Cl.[3] ..... F01K 25/10

[52] U.S. Cl. ..... 60/657; 60/671; 60/641.7; 60/649

[58] Field of Search ..... 60/651, 671, 649, 646, 60/657, 641.7

[56] References Cited

U.S. PATENT DOCUMENTS

| | | | |
|---|---|---|---|
| 3,364,125 | 1/1968 | Switzer, Jr. | 60/657 X |
| 3,967,450 | 7/1976 | Girardier | 60/671 X |
| 4,055,048 | 10/1977 | Reed | 60/657 X |

*Primary Examiner*—Allen M. Ostrager

*Attorney, Agent, or Firm*—Merriam, Marshall & Bicknell

[57] ABSTRACT

Apparatus for separating an undesired foreign fluid, such as water, from the working fluid, such as ammonia, in a low temperature difference power plant which includes an evaporator and a condensor. A flash separator unit vaporizes the working fluid and separates it from the undesired foreign fluid. The vaporized working fluid is condensed in the condensor. The undesired foreign fluid is accumulated in the evaporator from which it can then be removed. In an alternative embodiment, the separated foreign fluid and liquid ammonia collected in the flash separator unit are not returned to the evaporator, but instead, are coupled back into the flash separator where the separated foreign fluid accumulates so that at the end of the separation process, the undesired foreign fluid can be removed from the flash separator. An alternative embodiment enables the power generating system to continue in operation, although with a decreased capacity during the fluid separation process.

11 Claims, 2 Drawing Figures

SYSTEM FOR SEPARATION OF WATER FROM THE WORKING FLUID IN LOW TEMPERATURE DIFFERENCE POWER PLANTS

This invention relates to low temperature difference power generating systems and more particularly to improvements for removing foreign fluids from the working fluid of such systems.

BACKGROUND OF THE INVENTION

Reference may be made to the following U.S. patents of interest: U.S. Pat. Nos. 3,470,943; 4,138,851; 4,161,657; 4,189,924.

Various power generating systems utilizing low temperature differences existing in natural conditions in the United States and other countries, such as geothermal, solar, solar ponds, ocean thermal energy, etc. are presently under consideration or in some cases pilot plants have been constructed. In an ocean thermal energy conversion system described in the aforementioned U.S. Pat. No. 4,189,924, warm ocean water (at or near the surface) is vaporized and the resulting steam is used to drive the turbine/electrical generator. The exhaust steam is then condensed using relatively cold ocean water with the mixture then being returned to the ocean.

In proposed improved ocean thermal energy conversion power generating systems, the use of ammonia, propane or freon or other working fluids having a relatively lower boiling point than water have been proposed. As an example, it has been proposed to use ammonia as the working fluid in an electrical power plant based on a closed Rankine cycle utilizing the ocean temperature difference inherently available in the vicinity of Florida, Hawaii, Puerto Rico, etc. The working fluid, such as ammonia, is directed to an evaporator, where it is vaporized by heat supplied from warm ocean water. The saturated ammonia vapor is then fed to a turbine/electrical generator and thereafter to a condensor where cold ocean water condenses the ammonia which is then pumped back to the evaporator to complete the closed loop cycle.

However, if a small percentage of water exists in the loop, (either from a leakage or due to the initial charge of working fluid containing water), the water will concentrate in the evaporator since it is less volatile than the working fluid. The presence of water will increase the saturation temperature, relative to that of anhydrous ammonia, and in addition will cause a reduction in the heat transfer performance of the evaporator. As a result, the efficiency of the evaporator is decreased significantly which results in a decrease in the net power output of the system.

The desired separation of water from the working fluid, such as ammonia, is a very challenging engineering task since a large amount of ammonia has to be treated to remove only a few percent of water. Thus, while known available techniques for separating water from ammonia or similar fluids, such as distillation, membrane separation, or adsorption, have been proposed and could be utilized, they introduce a substantial amount of apparatus to the system, thereby making the system more complicated, subject to more frequent maintenance, and increase the overall system cost.

SUMMARY OF THE INVENTION

A low temperature difference power generating system is provided which includes an evaporator for vaporizing a working fluid by using hot or warm fluid as a heat source, such as warm ocean water, pumped into the evaporator. The vaporized working fluid is coupled to a turbine/electrical generator and thereafter condensed using cold fluid or water, such as available from deep ocean water. The condensed working fluid is then pumped back from the condensor to the evaporator to close a cycle. A flash separator unit is periodically operated to separate the working fluid from the undesired foreign fluid, such as water.

The ammonia vapor which is flashed off in the flash separator is then condensed by the cold fluid in the condensor, whereas the separated foreign fluid as well as unflashed liquid ammonia is collected in the flash separation unit chamber and is pumped back to the evaporator. The liquid ammonia collected in the flash separator unit chamber has a higher concentration of water, and after return to the evaporator, it is heated to achieve its initial conditions of temperature and pressure. At the end of the process, the condensor will be filled with pure liquid ammonia, and the small amount of water (or ammonia with higher concentration of water) will be left in the evaporator and can then be removed from the system. The present invention enables the foreign fluid (water) to be separated from the working fluid (ammonia) while utilizing components of the existing power generating system, thereby accomplishing the desired fluid separation at a minimum of additional components and cost.

In an alternative embodiment of the invention, the separated foreign fluid and liquid ammonia collected in the flash separator unit chamber is not returned to the evaporator, but instead is coupled back into the flash separator. Thus, at the end of the process in the second embodiment, the flash separator chamber will be filled with a small amount of water (or ammonia with a high concentration of water) which can then be removed through a bleed valve. An advantage of this alternative system is that the power generating system can continue to be operated, although with a decreased capacity, during the fluid separation process. Additional heat may be supplied to the liquid stream leaving the flash separator unit, in order to reduce the time required for the separation process, or, in instances where the rate of heat transfer in the evaporator is low due to very small overall temperature differences between the fluids applied to the evaporator.

BRIEF DESCRIPTION OF THE DRAWINGS

The features of this invention which are believed to be novel are set forth with particularily in the appended claims. The invention, together with its object and the advantages thereof, may be best understood by reference to the following description taken in conjunction with the accompanying drawings, in which like references numerals identify like elements in the several figures and in which:

DETAILED DESCRIPTION

Figure 1:
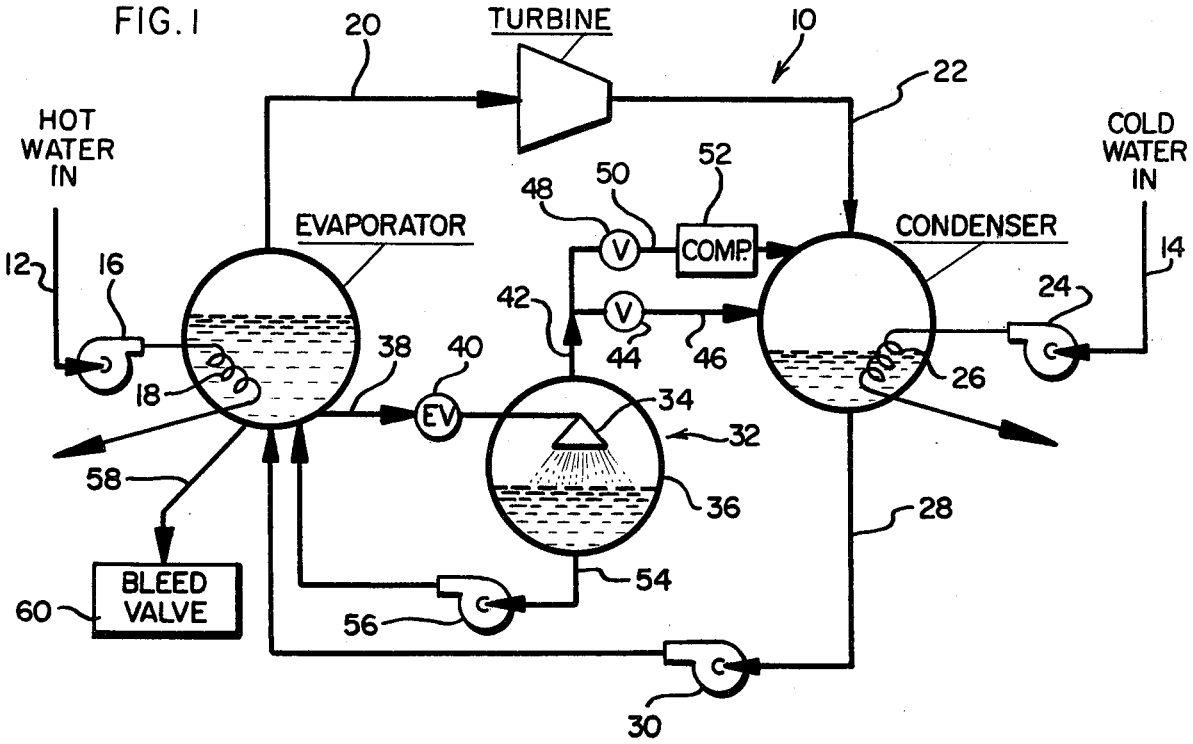
FIG. 1 is a schematic view illustrating a low temperature difference power generating system incorporating a fluid separator in accordance with the principles of the present invention.

Referring now to FIG. 1, there is illustrated a power generating system 10 obtaining energy from the temperature difference existing in hot or warm ocean water available at the surface, which is coupled to conduit 12, and cold or cool ocean water which is coupled to conduit 14. It is to be understood, while the present invention is described in connection with an ocean thermal energy conversion power plant, the invention is also applicable to other low temperature difference power plants, such as solar, solar ponds, geothermal, etc. In addition, the invention to be described herein is also applicable to all bottoming cycles or heat rejection cycles used in conventional power plants such as coal, oil, or nuclear, wherein a condensor is the heat source for the bottoming cycle and the environment serves as a heat sink. In such applications, the invention increases the efficiency of the condensor as well as the entire system and prevents excessive heat pollution. Also in such applications, the invention may be used with or without a power generating unit (turbine). Accordingly, the following description is only for purposes of illustrating an embodiment of the invention and is not to be used to limit its application to other systems.

In the illustrated system herein, ammonia is used as the working fluid due to its relatively low boiling point and thus is vaporized in the evaporator due to the presence of heat from warm ocean water through conduit 12, pump 16 and evaporator coils or tubes 18. A conduit 20 couples the vaporized ammonia to a turbine/electrical generator for generating electrical energy. The working fluid is then coupled from the turbine through conduit 22 into a condensor. Cool ocean water supplied through the condensor via conduit 14, pump 24 and coils or tubes 26, condenses the ammonia vapor and the condensate is pumped back to the evaporator through conduit 28 and pump 30.

As previously described if even a small percentage of water exists in the closed loop, water will concentrate in the evaporator and cause a reduction in the heat transfer coefficient and performance in the evaporator and a decrease in the power output of the power system. To separate the water from ammonia, there is provided a flash separator unit 32 which includes a spray device 34 and a separator chamber 36. Liquid ammonia is coupled from the evaporator through conduit 38 and an expansion valve 40 and after passing through spray unit 34, due to a suitable pressure in chamber 36, the ammonia is vaporized and exits the separation chamber through a conduit 42. If the temperature of the ammonia vapor in conduit 42 is higher than the condensor temperature as set by the cold water temperature inlet to the condensor, then valve 44 is opened to couple the ammonia through conduit 46 into the condensor. On the other hand, if the ammonia vapor temperature in conduit 42 is less than the condensor temperature, the ammonia vapor will be coupled through valve 48 and conduit 50 to a compressor 52 prior to entering the condensor.

The pressure in separation chamber 36 is adjusted as is well known in the art to vaporize the ammonia to the desired extent. As is recognized by those skilled in the art, the value of the chamber pressure is a parameter of the system, and will depend on several factors in the overall plant design, including plant capacity, percentage of water in the ammonia, the time allowed for the process of separating the water from ammonia, cost analysis, etc.

The liquid ammonia passing through spray unit 34 is collected in the separation chamber. The collected liquid ammonia has a higher concentration of water and is pumped back to the evaporator through conduit 54 and pump 56 where it is heated by the hot ocean water to achieve its initial temperature and pressure conditions. The separation process continues until a sufficient time has elapsed to provide the desired amount of separation. At the end of the process, the condensor will be filled with substantially pure liquid ammonia, and the separated small amount of water, (or in other words ammonia with a high concentration of water) will have been accumulated in the evaporator. The accumulated water can then be removed from the evaporator through conduit 58 and bleed valve 60. Once the separation process has been completed, the power generating system 10 can again be placed into operation with the desired higher efficiency than was obtained prior to the separation process.

Since the rate of heat transfer in the evaporator is low (because of small temperature differences) if it is desired to shorten the separation process, then it is advisable to provide an additional heating for the liquid stream exiting the separation chamber and passing through conduit 54 prior to reentering the evaporator.

Figure 2:
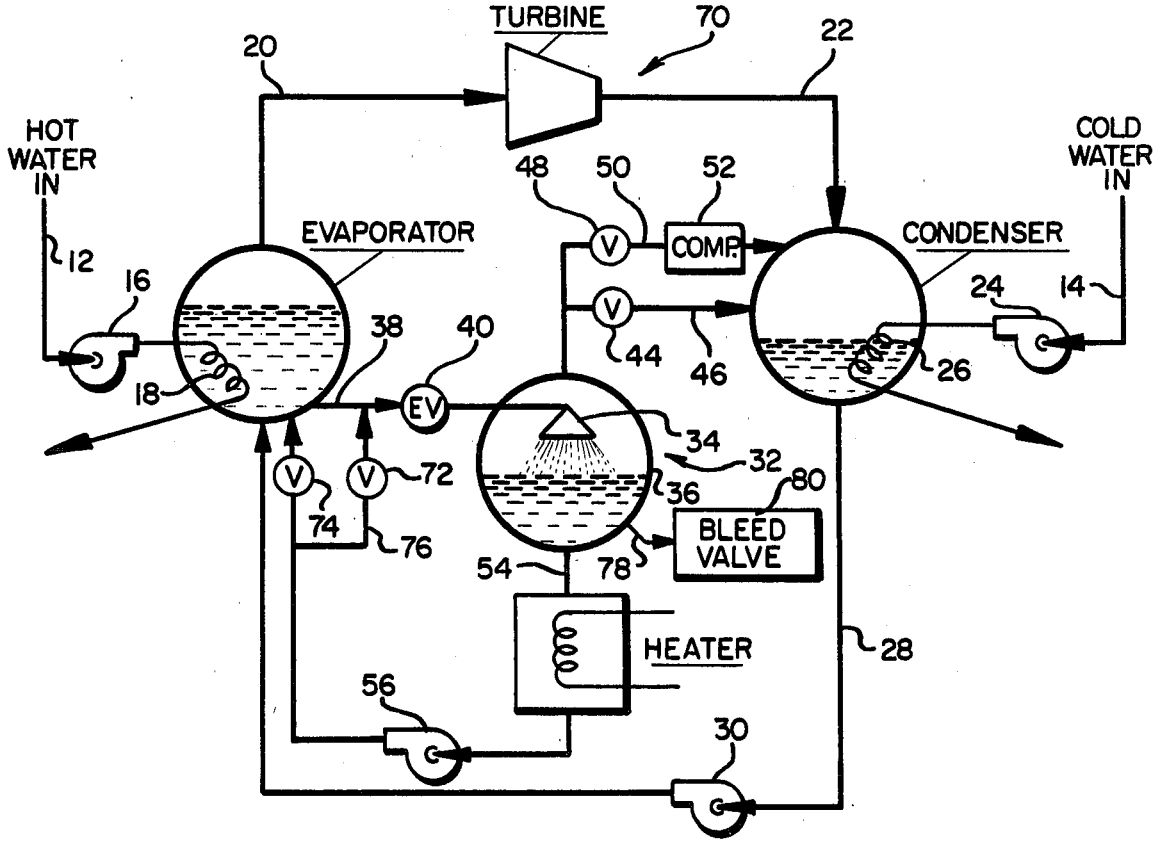
FIG. 2 is a schematic view illustrating an alternative embodiment of the invention in which the fluid separation process can occur during power generation.

Reference may now be made to FIG. 2, wherein there is illustrated an alternative embodiment of the present invention which permits the ammonia/water separation process to be conducted during power generation. In the illustrated low temperature differential power system 70 of FIG. 2, if valve 72 is open and valve 74 is closed, a small amount of liquid ammonia can be coupled from the evaporator and directed to the flash separator unit during power generation. The separation process will operate substantially in accordance with the previous description with respect to the system of FIG. 1, except that the separated liquid ammonia and water collected in chamber 36 is again recycled through conduit 54, pump 56, conduit 76 and valve 72, along with a small amount of liquid ammonia on conduit 38, back into the flash separator unit. A heater in conduit 54 is provided to reduce the amount of time required to complete the separation process.

After the separation process has been completed, separation chamber 36 will contain the separated water which can then be removed through conduit 78 and bleed valve 80. It is to be recognized that this alternative embodiment of the invention has the advantage of enabling the ammonia/water separation process to be conducted while the power generating system is operating, although at a reduced capacity. Thus, the described power generating system 70 of FIG. 2 does not need to be shut down in order to conduct the ammonia/water separation process.

Upon closing of valve 72 and opening of valve 74, the power generating system 70 can be adapted to include an ammonia/water separation process similar to that of described in connection with the power generating system shown in FIG. 1.

The foregoing detailed description has been given for clearness of understanding only, and no unnecessary limitations should be understood therefrom, as modifications will be obvious to those skilled in the art.

What is claimed is:

1. In a low temperature difference power generating system, including an evaporator, a condensor and a working fluid having a relatively low boiling point, the improvement of means for removing foreign fluid from said working fluid during non-operation of said power generating system, said improvement comprising a flash separator unit for vaporizing said working fluid and separating said vaporized working fluid from said foreign fluid, first conduit means for coupling working fluid and foreign fluid from said evaporator to said flash separator unit, and second conduit means for coupling said vaporized working fluid from said flash separator unit to said condensor.

2. A low temperature difference power generating system according to claim 1, wherein said second conduit means includes a compressor for said vaporized working fluid prior to entering said condensor.

3. A low temperature difference power generating system according to claim 1, including means for removing said separated foreign fluid from said system following sufficient concentration thereof.

4. A low temperature difference power generating system according to claim 3, including third conduit means for coupling said foreign fluid to said evaporator, and conduit means for removing said concentrated foreign fluid from said evaporator.

5. In a low temperature difference power generating system, including an evaporator, a condensor and a working fluid having a relatively low boiling point, the improvement of means for removing foreign fluid from said working fluid, said improvement comprising a flash separator unit for vaporizing said working fluid and separating said vaporized working fluid from said foreign fluid, first conduit means for coupling working fluid and foreign fluid from said evaporator to said flash separator unit, second conduit means for coupling said vaporized working fluid from said flash separator unit to said condensor, and third conduit means for coupling the separated foreign fluid from said flash separator unit to said first conduit means, said third conduit means including means for heating the separated foreign fluid, whereby the working fluid is separated from the foreign fluid during operation of the power generating system.

6. A low temperature difference power generating system according to claim 5, including means for removing said separated foreign fluid from said flash separator unit following sufficient concentration thereof.

7. A low temperature difference power generating system according to claim 5, wherein said second conduit means includes a compressor for said vaporized working fluid prior to entering said condensor.

8. A low temperature difference power generating system according to claim 5, wherein said third conduit means includes a bypass conduit for coupling said separated foreign fluid from said flash separator unit to said evaporator, and valve means for selectively controlling the flow of said separated foreign fluid either through said bypass conduit into said evaporator, or directly to said second conduit means.

9. A process for separating an undesired foreign fluid from the working fluid in a low temperature difference power generating system, including an evaporator, a condensor and a working fluid having a relatively low boiling point, said process comprising the steps of providing a flash separator unit, coupling the working fluid and foreign fluid from the evaporator to the flash separator unit for vaporizing the working fluid and separating the vaporized working fluid from the foreign fluid, and coupling the vaporized working fluid from the flash separator unit to the condensor, and accumulating the undesired foreign fluid for removal from said system.

10. The process according to claim 9, including the steps of coupling the separated foreign fluid from the flash separator unit back into the flash separator unit, and wherein the accumulation of the separated undesired foreign fluid is provided in the flash separator.

11. The apparatus according to claims 1 or 5 or the process according to claim 9, wherein said working fluid is ammonia and said undesired foreign fluid is water.

* * * * *